US009862567B2

(12) United States Patent
Saari et al.

(10) Patent No.: US 9,862,567 B2
(45) Date of Patent: Jan. 9, 2018

(54) GENERATING DESTINATION CALLS FOR ELEVATOR SYSTEM

(71) Applicant: KONE CORPORATION, Helsinki (FI)

(72) Inventors: Aapo Saari, Espoo (FI); Jussi Laurila, Helsinki (FI)

(73) Assignee: KONE CORPORATION, Helsinki (FI)

( * ) Notice: Subject to any disclaimer, the term of this patent is extended or adjusted under 35 U.S.C. 154(b) by 344 days.

(21) Appl. No.: 14/711,185

(22) Filed: May 13, 2015

(65) Prior Publication Data

US 2015/0314983 A1 Nov. 5, 2015

Related U.S. Application Data

(63) Continuation of application No. PCT/FI2013/051068, filed on Nov. 12, 2013.

(30) Foreign Application Priority Data

Nov. 14, 2012 (FI) ..... 20126194

(51) Int. Cl.

| | |
|---|---|
| ***B66B 1/34*** | (2006.01) |
| ***B66B 1/24*** | (2006.01) |
| ***B66B 1/46*** | (2006.01) |
| ***B66B 3/00*** | (2006.01) |

(52) U.S. Cl.

CPC ..... *B66B 1/2458* (2013.01); *B66B 1/3423* (2013.01); *B66B 1/468* (2013.01); *B66B 3/006* (2013.01); *B66B 2201/4615* (2013.01); *B66B 2201/4638* (2013.01); *B66B 2201/4676* (2013.01)

(58) Field of Classification Search

CPC ..... B66B 1/2458; B66B 1/3423; B66B 1/468; B66B 3/006; B66B 2201/4615; B66B 2201/4638; B66B 2201/4676

USPC ..... 187/247, 277, 313, 316, 317, 380–388, 187/391, 392, 393, 396; 340/541, 4.1, 340/5.2, 5.3, 5.6, 5.64, 5.8, 5.82

See application file for complete search history.

(56) References Cited

U.S. PATENT DOCUMENTS

| | | | | |
|---|---|---|---|---|
| 5,625,266 | A * | 4/1997 | Stark | G05B 19/0428 187/316 |
| 5,689,094 | A | 11/1997 | Friedli et al. | |
| 6,828,918 | B2 * | 12/2004 | Bowman | G06F 1/163 340/4.1 |
| 7,318,500 | B2 * | 1/2008 | Rekinen | B66B 1/34 187/391 |

(Continued)

FOREIGN PATENT DOCUMENTS

| | | |
|---|---|---|
| EP | 0 699 617 A1 | 3/1996 |
| EP | 2 402 275 A1 | 1/2012 |

(Continued)

*Primary Examiner* — Anthony Salata

(74) *Attorney, Agent, or Firm* — Birch, Stewart, Kolasch & Birch, LLP

(57) ABSTRACT

A method and system for generating automatic destination calls for an elevator system, in which system is a revolving door. A passenger approaching the revolving door or in a door sector of the revolving door is identified, a destination call to the home floor of the passenger is generated and the elevator serving the passenger is announced at the revolving door.

20 Claims, 2 Drawing Sheets

(56) References Cited

U.S. PATENT DOCUMENTS

Figure 1:
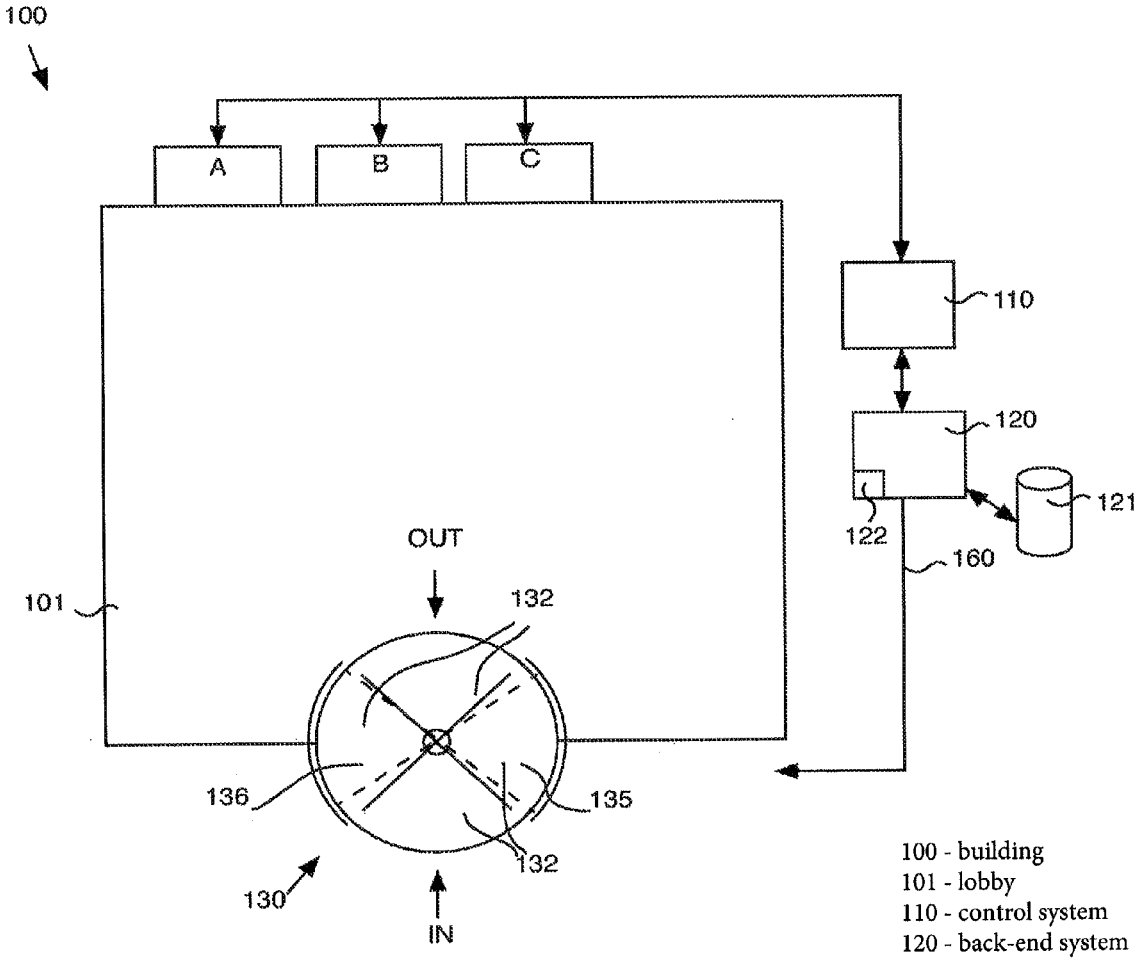

| | | | | |
|---|---|---|---|---|
| 7,581,622 | B2 * | 9/2009 | Amano | B66B 1/18 187/384 |
| 7,823,700 | B2 * | 11/2010 | Boss | B66B 1/468 187/247 |
| 7,913,820 | B2 * | 3/2011 | Sakurai | B66B 1/2458 187/384 |
| 8,061,485 | B2 * | 11/2011 | Finschi | B66B 1/468 187/384 |
| 8,490,754 | B2 * | 7/2013 | Amano | B66B 1/2458 187/384 |
| 8,813,917 | B2 * | 8/2014 | Salmikuukka | B66B 1/468 187/247 |
| 8,857,569 | B2 * | 10/2014 | Friedli | B66B 5/0012 187/384 |
| 8,910,752 | B2 * | 12/2014 | Furutani | B66B 1/468 187/384 |
| 2004/0017929 | A1 * | 1/2004 | Bramblet | G07C 9/00 382/103 |
| 2004/0262383 | A1 * | 12/2004 | Zielinski | G07C 9/00126 235/382 |
| 2008/0217112 | A1 | 9/2008 | Puskala et al. | |
| 2012/0160613 | A1 | 6/2012 | Friedli | |
| 2015/0106150 | A1 * | 4/2015 | Soleimani | H04L 63/10 705/7.19 |

FOREIGN PATENT DOCUMENTS

| | | | |
|---|---|---|---|
| WO | WO 00/40496 | A1 | 7/2000 |
| WO | WO 2007/026042 | A2 | 3/2007 |
| WO | WO 2009/130364 | A1 | 10/2009 |
| WO | WO 2012/089920 | A1 | 7/2012 |

* cited by examiner

100 - building
101 - lobby
110 - control system
120 - back-end system
121 - memory
122 - interface
130 - revolving door
132 - door sector
135 - entry sector
136 - exit sector
160 - device bus

GENERATING DESTINATION CALLS FOR ELEVATOR SYSTEM

CROSS REFERENCE TO RELATED APPLICATIONS

This application is a Continuation of PCT International Application No. PCT/FI2013/051068, filed on Nov. 12, 2013, which claims priority under 35 U.S.C. 119(a) to Patent Application No. 20126194, filed in the Finland on Nov. 14, 2012, all of which are hereby expressly incorporated by reference into the present application.

FIELD OF THE INVENTION

The present invention relates to elevator systems. More particularly the present invention relates to a method, and to a system for automatically generating destination calls for an elevator system on the basis of the identification of a person.

BACKGROUND OF THE INVENTION

In a destination floor elevator system a passenger gives to the elevator system one call, a so-called destination floor call, and not as in conventional elevator systems two calls such that the first call is given in the elevator lobby by designating the desired direction of travel with up/down-pushbuttons and the second call in the elevator car by designating with the car pushbuttons the destination floor, i.e. the target floor, of the passenger.

The destination floor can be given e.g. from a destination operating panel permanently installed in an elevator lobby. When a passenger keys his/her destination floor into the destination operating panel, the destination floor data, and also information about from which floor the call was given, is conveyed to the control system of the elevator system, to the so-called group control. On the basis of the given criteria the group control allocates an elevator from the elevator system for the use of the passenger and notifies the passenger of the allocated elevator, and possibly the location of it, e.g. on the display that is in the destination operating panel.

With regard to elevator systems, also known in the art is a call-giving method wherein a passenger is identified e.g. from an RFID identifier and a destination floor is determined for him/her on the basis of the identification. In this call-giving method a passenger e.g. takes an identifier in his/her possession manually to a reader device, which reads the information contained in the identifier, for example an individual ID number, and sends it to the group control of the elevator system. On the basis of the ID the group control determines the destination floor of the passenger, the so-called home floor, and allocates an elevator for the use of the passenger for traveling to the home floor in question. Also in this case the allocated elevator must be notified to the passenger if there are a number of elevators in the elevator system. Also known in the art are solutions in which the identifier is a so-called remote identifier, the identification data contained in which can be read when the identifier is e.g. in the pocket of the passenger.

To a constantly increasing extent elevator systems are connected to be a part of the access control of buildings. One prior-art solution is presented in publication EP 1924519, wherein a passenger has an identifier that is read e.g. outside the building. On the basis of the ID data contained in the identifier, it is checked, by identifying the ID, whether the person attempting to enter the building has a right of access to the building. If the access right is valid, the system opens an automatic door that is in connection with a reader device and orders an elevator to the entrance lobby floor.

Prior-art solutions have numerous problems. Identifiers to be read from a near-field distance require that a passenger takes his/her identifier in hand and brings it manually to a reader device that is in connection with a call-giving device. In peak-hour situations the call-giving device is easily congested because each passenger must use his/her identifier in the reader device. One problem with remotely-readable identifiers is that an indicator board showing all the calls and the elevators allocated to the calls must be arranged in connection with the elevator system. The information of the indicator board in this case becomes muddled, and individual passengers have difficulty finding from it the information applying to him/her. Since the indicator board is visible to everyone, personal messages intended to be visible only to a certain passenger cannot be shown on it either. Remotely-readable identifiers in connection with access control are also problematic because it is not possible to reliably know who of the identified passengers is going at any given time through an automatic door or access gate, enabling so-called "tailgating", in which a person without an access right follows a person who has an access right to a certain part of the building.

AIM OF THE INVENTION

The aim of the present invention is to eliminate or at least to alleviate the drawbacks presented above that occur in prior-art solutions. The aim of the invention is also to achieve one or more of the following objectives.

- to improve access control in buildings,
- to reduce congestion in passenger traffic nodes in buildings, and
- to facilitate the giving of private messages to passengers.

SUMMARY OF THE INVENTION

Some inventive embodiments are presented in the drawings in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments.

The present invention discloses a method for giving a destination call to an elevator system. The elevator system comprises a plurality of elevators, and in connection with which is a revolving door comprising at least one door sector, in connection with which are information means. According to the invention a passenger approaching the revolving door and/or a passenger in a door sector of the revolving door is identified, the home floor of the passenger is determined on the basis of the identification, a destination call to the aforementioned home floor is automatically generated, and an elevator serving the passenger is allocated for taking the passenger to the aforementioned home floor. The door sector into which the identified passenger goes, or in which the passenger is, is identified. The elevator allocated to him/her and/or other personal information is notified to the passenger with the information means when the passenger is inside the door sector.

The present invention also discloses a system for giving destination calls to an elevator system, which comprises a plurality of elevators and also a control system controlling the elevators. According to the invention the system further comprises: a revolving door comprising at least one door sector, in connection with which are information means; a back-end system, in connection with which are identification means for identifying passengers approaching the revolving door and/or in a door sector of the revolving door. The system is arranged to identify a passenger approaching the revolving door and/or in a door sector of the revolving door, to determine the home floor of the passenger on the basis of the identification, to automatically generate a destination call to the determined home floor and to allocate an elevator for taking the passenger to the aforementioned home floor. The system is further arranged: to identify the door sector into which the identified passenger goes or in which the passenger is; and the elevator serving him/her and/or other personal information is notified to the passenger with the information means when the passenger is inside the aforementioned door sector.

A home floor means any floor whatsoever in a building to which a passenger is probably going, e.g. a floor on which his/her workplace is situated or a floor on which he/she lives. The home floor can already be entered into the system manually. The system can also collect statistical data about the elevator journeys made by a passenger, and can deduce the home floor on the basis of the statistical data.

A passenger can be identified e.g. from an RFID identifier (Radio Frequency Identifier) in the possession of the passenger, from a code sent by a mobile device, from a magnetic card or from some other corresponding electrical identifier. Optical face recognition or some other corresponding biometric identification can also be utilized in the identification of a passenger. If a passenger approaching the revolving door is identified using remote identification technology, the system can be provided with monitoring means, by the aid of which the system receives information as to which door sector a passenger goes into, so that the passenger in the door sector can be given messages belonging specifically to him/her. Alternatively the identification means can be disposed in connection with the revolving door in such a way that an arriving passenger can be identified when the passenger is in a door sector of the revolving door, in which case the aforementioned monitoring means are not needed.

In one embodiment of the invention the system checks the access rights of the passenger on the basis of the aforementioned identification. If the passenger does not have a valid access right, the system prevents the automatic generation of a destination call and/or prevents at least momentarily use of the revolving door (i.e. locks the revolving door). As a result of the embodiment, access control of a building can be improved by preventing access into the building of a passenger without an access right and/or use of the elevators by that passenger.

In one embodiment of the invention passenger-specific messages are recorded in the system. When an identified passenger is in an identified door sector, messages intended for the passenger in question are notified to him/her with the information means that are in connection with the door sector. As a result of the embodiment, personal messages can be conveyed to passengers in good time e.g. when the passenger arrives in the building.

With the solution according to the invention numerous advantages are achieved compared to prior-art solutions. The solution according to the invention facilitates and speeds up the giving of automatic calls by utilizing remote identification and by giving to a passenger messages relating to the call and/or other personal messages with information means that are in a door sector of the revolving door. Since in the solution according to the invention the door sector into which an arriving passenger goes is identified, personal messages intended only for him/her can be presented to the passenger. Also the amount of information to be presented decreases because information intended for other passengers does not need to be presented to the passenger, as must be done in solutions known in the art. The solution according to the invention also improves access control because who is trying to enter the building and which sector of the revolving door he/she is using to enter the building can be identified in the system, in this way preventing, inter alia, the aforementioned "tailgating".

LIST OF FIGURES

Figure 2:
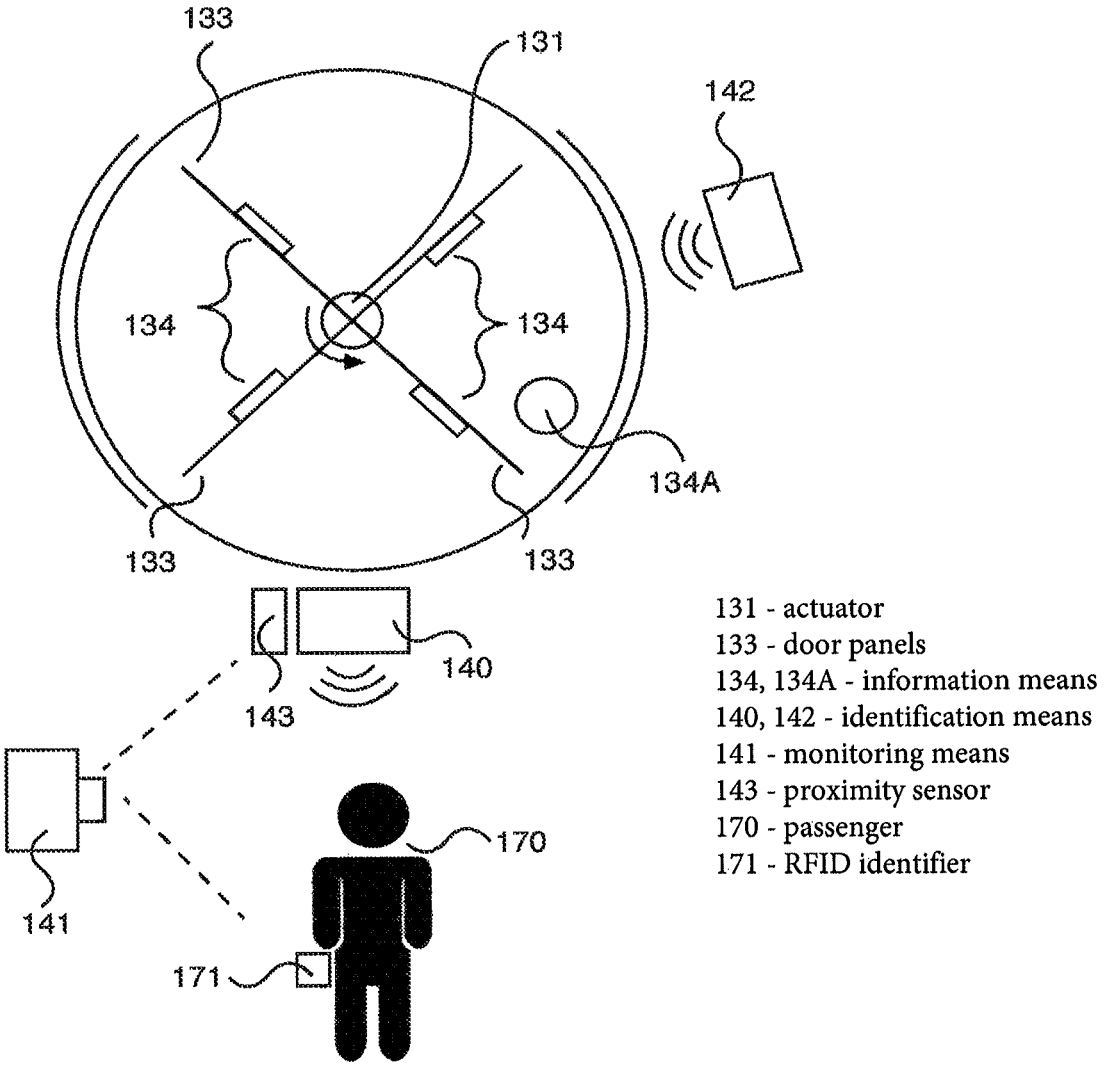

FIG. 1 presents one embodiment of the system according to the present invention;

FIG. 2 presents a more detailed view of the revolving door of FIG. 1.

DETAILED DESCRIPTION OF THE INVENTION

FIG. 1 presents one system according to the invention. The system comprises an elevator system that is in a building 100, which elevator system comprises elevators A, B and C and also a control system 110 controlling the elevator system. The system also comprises a back-end system 120 for access control as well as a revolving door 130, via which people arriving in the building have access to the entrance lobby 101 of the building. As can be seen from FIG. 2, in connection with the revolving door 130 is an actuator 131, by controlling which the revolving door can be made to rotate counterclockwise in such a way that passenger traffic coming into the building can use the side marked with the arrow IN and passenger traffic leaving the building the side marked with the arrow OUT. The actuator 131 also comprises an angle sensor, from which the back-end system receives information about which door sectors are at the point of the entry sector 135 at any given time. Marked in FIG. 1 with the reference number 160 is a device bus, to which devices belonging to the system, such as e.g. identification means 140, 142, monitoring means 141, then actuator 131 of the revolving door, information means 134, 134A can be connected.

The revolving door 130 comprises four door sectors 132, which are separated from each other by the door panels 133 of the revolving door. In each door sector are information means 134, by the aid of which messages, e.g. which elevator is serving the passenger, the location of the elevator and/or other personal messages, can be transmitted to a person in each door sector 132. The door sectors 132 rotate in synchronization in relation to each other when the actuator 131 rotates the door panels 133. In FIG. 1 marked with dashed lines is a so-called entry sector with the reference number 135, which does not rotate as the door sectors do but instead is an area inside the revolving door, via which a passenger must go when he/she tries to enter the entrance lobby of the building. Correspondingly, marked with dashed lines in FIG. 1 is a so-called exit sector 136, which is an area inside the revolving door, via which people leaving the building must go.

Marked in FIG. 2 with the reference number 140 are identification means, by the aid of which a person/passenger 170 entering the building can be identified by reading the electrical identifier, e.g. a remotely-readable RFID identifier 171, that is in his/her possession. The identification data (ID) contained in the identifier is conveyed from the identification means 140 to the back-end system 120. The back-end system checks whether the person identified by the ID has an access right to the building. If the access right is valid, the back-end system searches from the memory 121 of the back-end system the destination floor corresponding to the ID (the home floor of the person) and on the basis of it sends a destination call to the control system 110. The control system allocates an elevator to the passenger 170 arriving at the building and transmits information about the serving elevator A, B or C to the back-end system 120. The back-end system sends to the actuator 131 a start command, in which case the door panels/door sectors of the revolving door start to rotate. When a passenger goes into some door sector 132 of the revolving door, the back-end system notifies, with the information means 134 of the door sector in question, which elevator the passenger should use to get to his/her home floor. For example, if the message is "Floor 9, elevator A", the passenger knows that he/she will get from the entrance lobby to floor 9 with the elevator A.

Personal messages intended for arriving passengers can also be recorded in the memory 121 of the back-end system via an interface 122, which messages are notified to each passenger with the information means 132 that are in the door sector used by the passenger.

For example, a passenger can be requested to go to conference room 9R with the message "Conference room 9R, elevator A". The message can also be of the type that it changes the destination floor of the automatic destination call or prevents the automatic destination call altogether. For example, if a colleague of the person is waiting in a café on floor 10, the colleague can record in the memory 121 of the back-end system a message indicating this. When the person arrives in the building, the system orders an elevator to floor 10 for the person and informs him/her of this with the information means in the door sector, e.g. with the message "NN is waiting in the café on floor 10, elevator A". The back-end system can also prevent the giving of a destination call on the basis of a message recorded in the memory 121 of the back-end system. If a person e.g. does not have a right of access to the building the back-end system does not generate an automatic destination call but instead guides the person arriving to the reception desk of the entrance lobby by announcing with the information means e.g. "Contact reception".

So that a person arriving in the building can in the door sector be given messages intended just for him/her, the back-end system 120 must know who is in which door sector 132. If identification of a passenger occurs as remote identification outside the revolving door 130, as in FIG. 2, connected to the system can be monitoring means 141, e.g. a camera system, by the aid of which the back-end system can "monitor" on the basis of the ID into which door sector an identified person goes. Alternatively, identification of a passenger can be performed in the revolving door by providing the revolving door with identification means 142, which read an RFID identifier in the possession, e.g. in a pocket, of the person in the entry sector 135. In this latter embodiment, the back-end system 120 knows immediately, on the basis of the moment of identification, in which door sector the person is, in which case the aforementioned monitoring means 141 are not needed in the system.

In FIG. 2 the actuator 131 is connected to the back-end system via a device bus 160. When the back-end system has identified a person approaching the revolving door and verified that his/her access right(s) is/are valid, the back-end system sends to the actuator 131 a start command, making the revolving door rotate. If the person does not have a valid access right, the back-end system can stop/lock the revolving door by controlling the actuator 131. Alternatively the revolving door can be provided with a proximity sensor 143, on the basis of the signal given by which the actuator 131 is always controlled on when someone approaches the revolving door 130. All persons thus have access to the entrance lobby of the building but the back-end system orders an elevator only for identified persons.

The identification of a passenger can be based on any identification technology whatsoever that is suited to the purpose, such as e.g. the aforementioned RFID technology, NFC technology, Bluetooth technology or identification technologies occurring from a video image. Preferably the identification occurs as remote identification without manual operations but also identification technologies in which a passenger manually takes his/her identifier to an identification device can be applied in the present invention. In manual identification e.g. a reader device can be arranged in front of the revolving door, to which reader device an arriving passenger takes his/her identifier so that the ID contained in it can be read and transmitted to the back-end system.

The information means that are in connection with the revolving door can be any visual and/or auditory information means whatsoever. In FIG. 2 display devices 134 are integrated into the door panels (into the door sectors) of the revolving door and sound reproduction devices 134A into the roof of the revolving door at the point of the entry sector. Since the sound reproduction devices are disposed on the roof of the revolving door, only one set of sound reproduction devices is needed in a revolving door. Conventional panel displays or transparent display elements integrated into the door panels, for example, can be used as display devices.

As presented above, the home floor of each passenger, to which floor he/she will probably travel and on the basis of which an automatic destination call is generated, is recorded in the back-end system 120. The home floor can be recorded in the memory 121 e.g.

manually or the system collects statistical data about the elevator journeys made by each passenger and deduces the home floor on the basis of the statistical data collected. For collecting statistical data the elevator system can be provided with identification means for identifying passengers e.g. in the elevator cars and/or in the elevator lobbies (not presented in the figures). Also the access control can be improved by disposing identification means in the elevator cars and by observing to which floors passengers go.

The invention is not only limited to be applied to the embodiments described above, but instead many variations are possible within the scope of the inventive concept defined by the claims. Thus, for example, the revolving door does not need to be the entrance door of the building, but instead it can be anywhere whatsoever inside the building separating two spaces from each other. The system can also have more than one revolving door that passengers can use. The invention can be applied to exiting passenger traffic in addition to incoming passenger traffic. It is also obvious to the person skilled in the art that the control system of the elevator system can comprise a number of control units and/or the back-end system of the access monitoring is integrated into the control system of the elevator system.

The invention claimed is:

1. A method for generating automatic destination calls for an elevator system, the elevator system comprising a plurality of elevators, a control system of the elevator system, an identification device configured to identify passengers, and a revolving door comprising at least one door sector, in connection with which door sector are information means for notifying an information device configured to notify messages to a passenger in a door sector, said method comprising the steps of:

identifying a passenger approaching the revolving door and/or a passenger in a door sector;

determining the home floor of the passenger on the basis of the identification;

automatically generating a destination call to the home floor; allocating an elevator to the passenger for taking the passenger to the home floor;

identifying the door sector in which the passenger is located;

notifying the passenger of the elevator serving him/her and/or other personal information with the identification device that is in connection with the door sector.

2. The method according to claim 1, wherein a passenger is identified from an electrical identifier that is in the possession of the passenger.

3. The method according to claim 1, wherein a passenger is identified from a video image.

4. The method according to claim 1, wherein the method further comprises the steps of:

checking the access rights of a passenger on the basis of the identification; and preventing the generation of a destination call and/or preventing the use of the revolving door at least momentarily, if the passenger does not have a valid access right.

5. The method according to claim 1, wherein the method further comprises the steps of:

using remote identification for identifying a passenger approaching the revolving door; and monitoring the door sector to which the identified passenger goes for identifying the door sector.

6. The method according to claim 1, wherein the method further comprises the step of identifying a passenger when the passenger is in the entry sector of the revolving door.

7. The method according to claim 1, wherein the method further comprises the steps of:

collecting statistical data about the destination calls of a passenger; and determining the home floor of the passenger on the basis of the collected statistical data.

8. A system for giving destination calls to an elevator system, comprising:

a plurality of elevators;

a control system of the elevator system, which control system is arranged to allocate to each passenger an elevator from the elevator system;

a revolving door comprising at least one door sector, in connection with which are an information device;

a back-end system, in connection with which are an identification device configured to identify a passenger approaching the revolving door and/or in the entry sector of the revolving door; and a device configured to identify the door sector into which the identified passenger goes and/or in which the passenger located, wherein the system determines the home floor of the passenger on the basis of the identification, automatically generates a destination call to the home floor, allocates an elevator to the passenger for taking the passenger to the home floor, and notifies to the passenger in the door sector the elevator allocated to him/her and/or other personal information with the information device that is in connection with the identified door sector.

9. The system according to claim 8, wherein: the identification device is arranged to read the identification data contained in an identifier in the possession of a passenger.

10. The system according to claim 8, wherein the identification device utilizes biometric identification for identifying a passenger.

11. The system according to claim 1, wherein the system is arranged to check the access rights of a passenger and to prevent the generation of a destination call and/or at least momentarily the use of the revolving door if the passenger does not have a valid access right.

12. The system according to claim 1, wherein the identification device is arranged to identify a passenger approaching the revolving door.

13. The system according to claim 1, wherein the identification device is arranged to identify a passenger in the entry sector of the revolving door.

14. The system according to claim 1, wherein the system comprises a memory, in which the system is arranged to collect statistical data about the elevator journeys made by identified passengers and to deduce the home floor of each passenger on the basis of the aforementioned statistical data.

15. The system according to claim 1, further comprising an interface, via which passenger-specific messages can be recorded in the system for presenting with the information device.

16. The method according to claim 2, wherein the method further comprises the steps of:

checking the access rights of a passenger on the basis of the identification; and preventing the generation of a destination call and/or preventing the use of the revolving door at least momentarily, if the passenger does not have a valid access right.

17. The method according to claim 3, wherein the method further comprises the steps of:

checking the access rights of a passenger on the basis of the identification; and preventing the generation of a destination call and/or preventing the use of the revolving door at least momentarily, if the passenger does not have a valid access right.

18. The method according to claim 2, wherein the method further comprises the steps of:

using remote identification for identifying a passenger approaching the revolving door; and monitoring the door sector to which the identified passenger goes for identifying the door sector.

19. The method according to claim 3, wherein the method further comprises the steps of:

using remote identification for identifying a passenger approaching the revolving door; and monitoring the door sector to which the identified passenger goes for identifying the door sector.

20. The method according to claim 4, wherein the method further comprises the steps of:

using remote identification for identifying a passenger approaching the revolving door; and monitoring the door sector to which the identified passenger goes for identifying the door sector.

* * * * *